US005795243A

United States Patent [19]

Chang et al.

[11] Patent Number: 5,795,243

[45] Date of Patent: Aug. 18, 1998

[54] CLUB HEAD WITH A SHOCK ABSORBING HOSEL

[75] Inventors: Poh-Heng Chang, Melaka, Malaysia; Chung-Jong Sung, Hsinying, Taiwan

[73] Assignee: Sung Ling Golf & Casting Co., Ltd., Tainan, Taiwan

[21] Appl. No.: 814,587

[22] Filed: Mar. 10, 1997

[51] Int. Cl.[6] ..... A63B 53/02

[52] U.S. Cl. ..... 473/310

[58] Field of Search ..... 473/309, 310, 473/305, 308; 403/225

[56] References Cited

U.S. PATENT DOCUMENTS 1,850,843 3/1932 Lagerblade ..... 473/309

*Primary Examiner*—Sebastiano Passaniti
*Assistant Examiner*—Stephen L. Blau
*Attorney, Agent, or Firm*—Varndell Legal Group

[57] ABSTRACT

A tubular hosel of a club head, having an internally and externally recessed middle section formed of a plurality of thick wall portions and thin wall portions alternatively arranged together around the periphery, and a shock absorbing rubber molded on the middle section and filled up through holes on the thin wall portions and covered on the thick wall portions and the thin wall portions in a flush manner.

1 Claim, 2 Drawing Sheets

CLUB HEAD WITH A SHOCK ABSORBING HOSEL

BACKGROUND OF THE INVENTION

The present invention relates to golf club heads, and more specifically to a tubular hosel of a club head which has an internally and externally recessed middle section covered with a shock absorbing rubber by molding.

A golf club head is generally comprised of a casing having a face, and a unitary tubular hosel extended from the casing at one end and adapted for fastening to a shaft. Because the tubular hosel is made from rigid metal, it tends to cause a resonance when the club head hits the ball. Therefore, shock waves are produced and transmitted from the tubular hosel through the shaft to the player's hands when the club head hits the ball, thereby causing the wrists of the player's hands to ache.

SUMMARY OF THE INVENTION

The present invention has been accomplished to provide a golf club head with a shock absorbing hosel which eliminates the aforesaid problem. According to the present invention, the tubular hosel of the club head has an unevenly recessed outside wall and an unevenly recessed inside wall in the middle, defining a plurality of thick wall portions and thin wall portions alternatively arranged together around the periphery. A shock absorbing rubber is molded on inside and outside surfaces of the middle section of the tubular hosel and filled up through holes on the thin wall portions and covered on the thick wall portions and the thin wall portions in a flush manner. Therefore, the tubular hosel can absorb shock waves and eliminate the occurrence of a resonance when the club head hits the ball.

DETAILED DESCRIPTION OF THE PREFERRED EMBODIMENT

Figure 2:
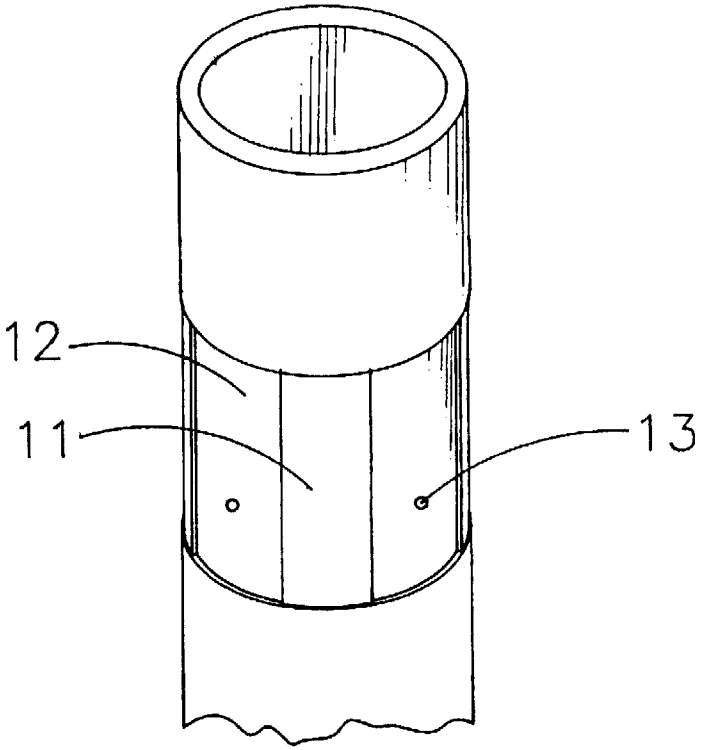
FIG. 2 is an enlarged view of the tubular hosel of the club head shown in FIG. 1.
Figure 1:
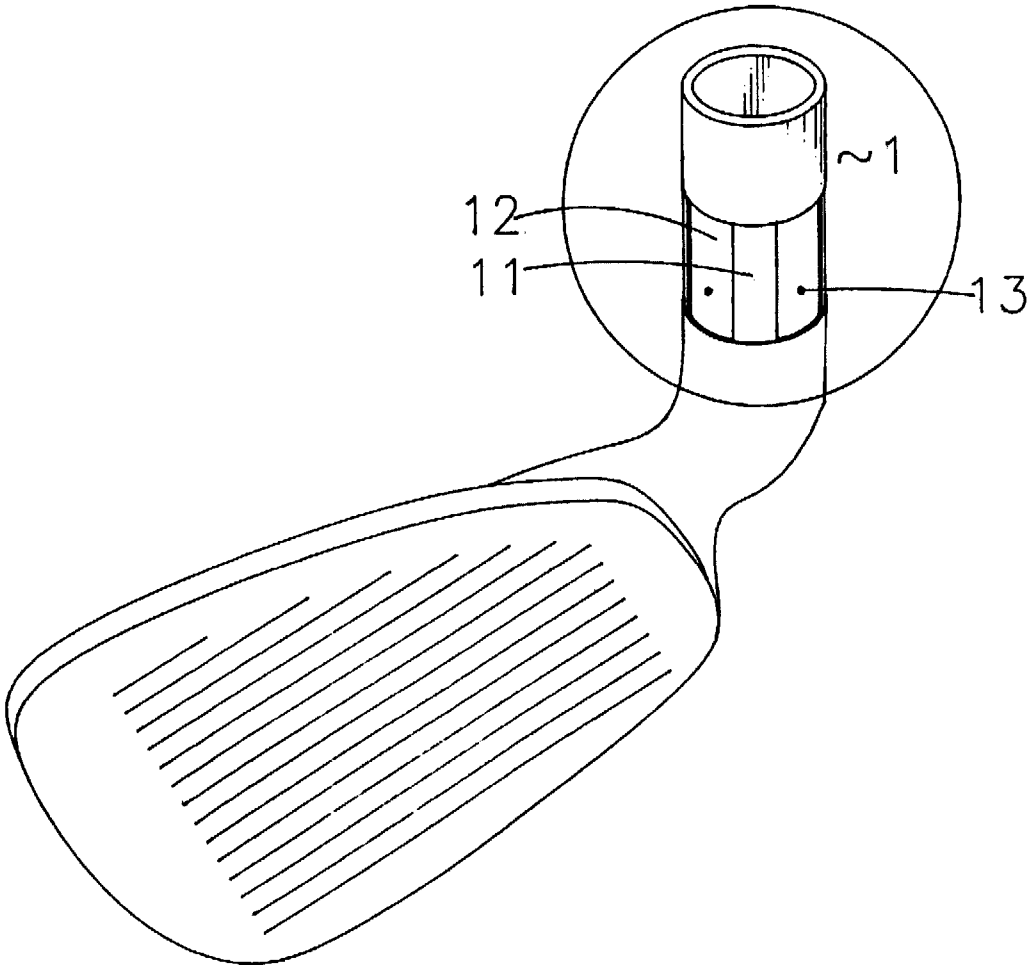
FIG. 1 shows the structure of the tubular hosel of a club head according to the present invention before the molding of the shock absorbing rubber.
Figure 4:
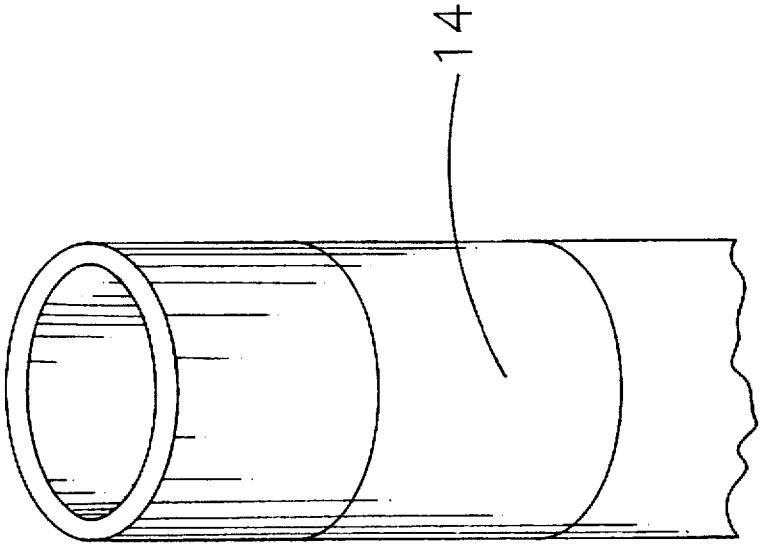
FIG. 4 shows the shock absorbing rubber molded on the middle section of the tubular hosel according to the present invention.
Figure 3:
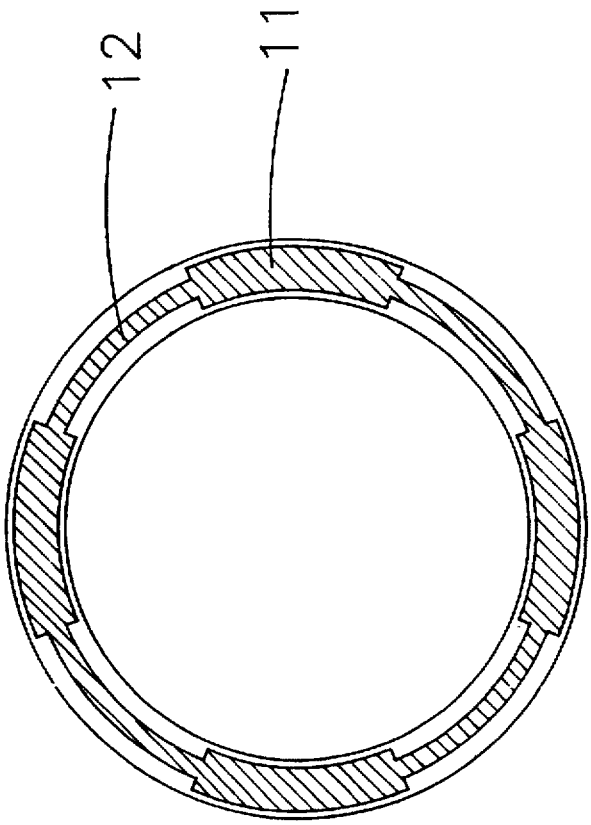
FIG. 3 is a cross sectional view in an enlarged scale of the middle section of the tubular hosel of the club head shown in Figure.

Referring to FIGS. from 1 to 4, a club head in accordance with the present invention has a tubular hosel 1 adapted for fastening to a shaft. The tubular hosel 1 comprises an internally and externally recessed middle section formed of a plurality of thick wall portions 11 and thin wall portions 12 alternatively together around the periphery, a plurality of through holes 13 on the thin wall portions 12, and a shock absorbing rubber 14 directly molded on the middle section (namely, the thick wall portions 11 and thin wall portions 12) in a flush manner. When the shock absorbing rubber 14 is molded on both sides of the middle section of the tubular hosel 1, it fills up the through holes 13 (molten rubber passes through the through holes 13 between the outside wall and inside wall of the middle section of the tubular hosel 1).

When the club head hits the ball, the shock absorbing rubber 14 absorbs most of the shock waves. Further, because the middle section of the tubular hosel 1 is comprised of a plurality of thick wall portions 11 and thin wall portions 12 alternatively arranged together around the periphery, shock waves are transmitted through the thick wall portions 11 and the thin wall portions 12 at different transmission speeds, therefore the middle section of the tubular hosel 1 eliminate the occurrence of a resonance.

It is to be understood that the drawings are designed for purposes of illustration only, and are not intended as a definition of the limits and scope of the invention disclosed.

We claim:

1. A club head having a tubular hosel adapted for fastening to a shaft, wherein said tubular hosel comprises an internally and externally recessed middle section formed of a plurality of thick wall portions and thin wall portions alternatively arranged together around the periphery, a plurality of through holes on said thin wall portions, and a shock absorbing rubber molded on said middle section and filled up said through holes and covered on said thick wall portions and said thin wall portions in a flush manner.

* * * * *